US012161278B2

(12) United States Patent
Choi et al.

(10) Patent No.: US 12,161,278 B2
(45) Date of Patent: Dec. 10, 2024

(54) DISHWASHER AND HOME APPLIANCE

(71) Applicant: SAMSUNG ELECTRONICS CO., LTD., Suwon-si (KR)

(72) Inventors: Sangsoo Choi, Suwon-si (KR); Youngjae Kim, Suwon-si (KR); Eunseok Kim, Suwon-si (KR); Youngsu Ser, Suwon-si (KR); Hyeoneui Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 94 days.

(21) Appl. No.: 18/073,667

(22) Filed: Dec. 2, 2022

(65) Prior Publication Data

US 2023/0102753 A1 Mar. 30, 2023

Related U.S. Application Data

(63) Continuation of application No. PCT/KR2021/004751, filed on Apr. 15, 2021.

(30) Foreign Application Priority Data

Jun. 11, 2020 (KR) ..... 10-2020-0070783

(51) Int. Cl.
*A47L 15/42* (2006.01)

(52) U.S. Cl.
CPC ..... *A47L 15/4265* (2013.01)

(58) Field of Classification Search
CPC ..... A47L 15/4265; A47L 15/4257
See application file for complete search history.

(56) References Cited

U.S. PATENT DOCUMENTS 4,732,431 A * 3/1988 Mason ..... A47L 15/4265 312/109
5,806,942 A * 9/1998 Jenkins, Jr. ..... A47L 15/4265 312/265.6
6,736,470 B2 5/2004 Manke et al.
(Continued)

FOREIGN PATENT DOCUMENTS

JP 11-62410 A 3/1999
KR 0111184 Y1 4/1995
(Continued)

OTHER PUBLICATIONS

International Search Report issued in International Application No. PCT/KR2021/004751 dated Jul. 22, 2021.
(Continued)

*Primary Examiner* — Daniel J Rohrhoff
(74) *Attorney, Agent, or Firm* — STAAS & HALSEY LLP

(57) ABSTRACT

A home appliance including a door having an improved coupling structure. The home appliance includes a door that includes: a door body; an upper frame mountable on an upper portion of the door body; a front panel coupleable to and decoupleable from a front of the door body; and a fixer formed at a rear surface of the front panel and coupleable to a coupling member to fix the front panel to the door body, wherein the coupling member is coupled to the fixer by penetrating a side of the door body with no interference with the upper frame while the upper frame is mounted on the upper portion of the door body.

15 Claims, 19 Drawing Sheets

(56) References Cited

U.S. PATENT DOCUMENTS

| | | | | |
|---|---|---|---|---|
| 7,014,281 | B2 * | 3/2006 | Wuestefeld | A47L 15/4265 312/204 |
| 9,084,527 | B2 * | 7/2015 | Haft | A47L 15/4257 |
| 9,775,489 | B1 * | 10/2017 | Ponkshe | A47L 15/4265 |
| 11,047,613 | B1 * | 6/2021 | Park | A47B 96/201 |
| 2003/0067254 | A1 * | 4/2003 | Manke | A47L 15/4265 312/265.6 |
| 2009/0045705 | A1 * | 2/2009 | Laible | A47B 96/20 312/204 |
| 2022/0142450 | A1 * | 5/2022 | Ko | E05D 3/18 |
| 2022/0142451 | A1 * | 5/2022 | Ko | A47L 15/4261 |
| 2023/0009434 | A1 * | 1/2023 | Hong | F25D 23/02 |
| 2023/0152504 | A1 * | 5/2023 | Han | F25D 23/02 362/606 |
| 2023/0371190 | A1 * | 11/2023 | Berry | H01G 9/04 |

FOREIGN PATENT DOCUMENTS

| | | | |
|---|---|---|---|
| KR | 0115016 | Y1 | 7/1997 |
| KR | 1999-011183 | U | 3/1999 |
| KR | 20-0272326 | Y1 | 4/2002 |
| KR | 10-1054115 | B1 | 8/2011 |
| KR | 10-1162204 | B1 | 7/2012 |
| KR | 10-1162206 | B1 | 7/2012 |
| KR | 10-1193283 | B1 | 10/2012 |
| KR | 10-1268823 | B1 | 5/2013 |
| KR | 10-2016-0135545 | A | 11/2016 |

OTHER PUBLICATIONS

International Written Opinion issue in International Application No. PCT/KR2021/004751 dated Jul. 22, 2021.

* cited by examiner

DISHWASHER AND HOME APPLIANCE

CROSS-REFERENCE TO RELATED APPLICATIONS

This application is a continuation application, under 35 U.S.C. § 111(a), of International Patent Application No. PCT/KR2021/004751, filed on Apr. 15, 2021, which claims the benefit of Korean Patent Application No. 10-2020-0070783, filed on Jun. 11, 2020, in the Korean Intellectual Property Office, the entire disclosures of each of which are incorporated herein by reference as a part of this application.

BACKGROUND

Field

The present disclosure relates to a dishwasher and a home appliance, and more particularly, to a dishwasher and a home appliance including a door having an improved coupling structure.

Description of Related Art

A home appliance, such as a refrigerator, an oven, a microwave, etc., includes a door for opening or closing a space provided inside a main body.

A dishwasher corresponding to an example of such a home appliance is a machine for automatically washing off food residues, etc. remaining on dishes with a detergent and washing water.

The dishwasher includes a housing forming an outer appearance, a washing room formed by a tub positioned inside the housing, a door for opening or closing the washing room, a storage container positioned inside the washing room to store dishes, and an arm assembly configured to spray washing water toward the storage container.

SUMMARY

A home appliance according to the disclosure includes a door that includes: a door body; an upper frame mountable on an upper portion of the door body; a front panel coupleable to and decoupleable from a front of the door body; and a fixer formed at a rear surface of the front panel and coupleable to a coupling member to fix the front panel to the door body, wherein the coupling member is coupled to the fixer by penetrating a side of the door body to prevent interference with the upper frame while the upper frame is mounted on the upper portion of the door body.

The door body may include a coupling recess forming an opening toward a front direction, the fixer being insertable into the coupling recess through the opening, wherein a coupling hole exposed to an outside of the door body and through which the coupling member penetrates may be formed on a surface of the coupling recess.

The coupling member which penetrates the coupling hole may be coupled to a side surface of the fixer while the fixer is inserted into the coupling recess.

While the fixer is inserted in the coupling recess, a direction in which the fixer is inserted in the coupling recess may be perpendicular to a direction in which the coupling member penetrates the coupling hole.

The door body may include an insertion recess formed by depressing a surface of the side of the door body and, wherein the coupling member may be inserted into the insertion recess and through to the coupling hole and the coupling recess.

The home appliance may further include a cap coupleable to the insertion recess and configured to cover the coupling member inserted in the insertion recess.

The home appliance may further include a trim on the rear surface of the front panel, forming an installing groove, and coupleable to the door body by being rotatable with respect to the door body such that a portion of the door body is inserted in the installing groove.

The fixer may be at an upper portion of the front panel, and the trim may be at a lower portion of the front panel.

The installing groove may open is open along a downward direction, the door body may include a coupling protrusion formed to protrude along an upward direction from a lower surface of the door body, the coupling protrusion may be insertable into the installing groove, and the front panel may be supported by the lower surface of the door body.

The trim and the installing groove may be a first trim and a first installing groove, respectively, the home appliance may further include: a second trim at an edge of the rear surface of the front panel; and a third trim at an edge of a front surface of the door body to correspond to the second trim, and forming a second installing groove in which the second trim is insertable.

The second trim may be elastically deformable, and the third trim may include a guide portion configured to induce one end of the second trim to be deformed such that the one end of the second trim is toward the second installing groove upon mounting of the front panel on the door body, and a support portion configured to support the second trim by contacting the second trim upon inserting of the one end of the second trim in the second installing groove.

The home appliance may further include a coupling guide formed to protrude from an inner side surface of the door body and configured to support the upper frame.

The upper frame may include a frame portion, and a fixing portion formed to protrude along a downward direction from the frame portion and supported by the coupling guide, wherein a coupling protrusion may be formed on one surface of the fixing portion, and the coupling protrusion may be insertable into and supportable by an installing groove formed by the coupling guide.

Upon mounting of the upper frame on the door body, the coupling protrusion may slide along a front-rear direction in the installing groove, and the coupling guide may guide a movement of the coupling protrusion.

A handle may be formed on the upper frame.

A dishwasher according to the disclosure includes: a housing forming a washing room therein; and a door configured to open or close the washing room, wherein the door includes: a door body coupleable to the housing; a front panel coupleable to and decoupleable from a front of the door body; an upper frame mountable on the door body and including a handle; a trim provided on a front surface of the door body, wherein a first installing groove formed to extend along an up-down direction is formed in the trim to mount the front panel; and a coupling guide provided in an upper end of the door body, wherein a second installing groove formed to extend along a front-rear direction is formed in the coupling guide to mount the upper frame.

The trim may be a first trim, the dishwasher may further include a second trim provided on a rear surface of the front panel to correspond to the first trim and formed to extend along the up-down direction, and the second trim may be inserted in the first installing groove and installed.

The upper frame may include a frame portion, and a fixing portion formed to protrude downward from the frame portion and supported by the coupling guide, wherein a coupling protrusion extending in the front-rear direction is formed on one surface of the fixing portion, and the coupling protrusion may be inserted in the second installing groove and installed.

The door may further include a fixer positioned at an upper end of the front panel and coupleable to a coupling member to fix an upper portion of the front panel to the door body, and a third trim provided in a lower portion of the front panel, extending in a left-right direction, and configured to fix a lower portion of the front panel to the door body.

The coupling guide may be integrated into the door body.

DETAILED DESCRIPTION

Figure 1:
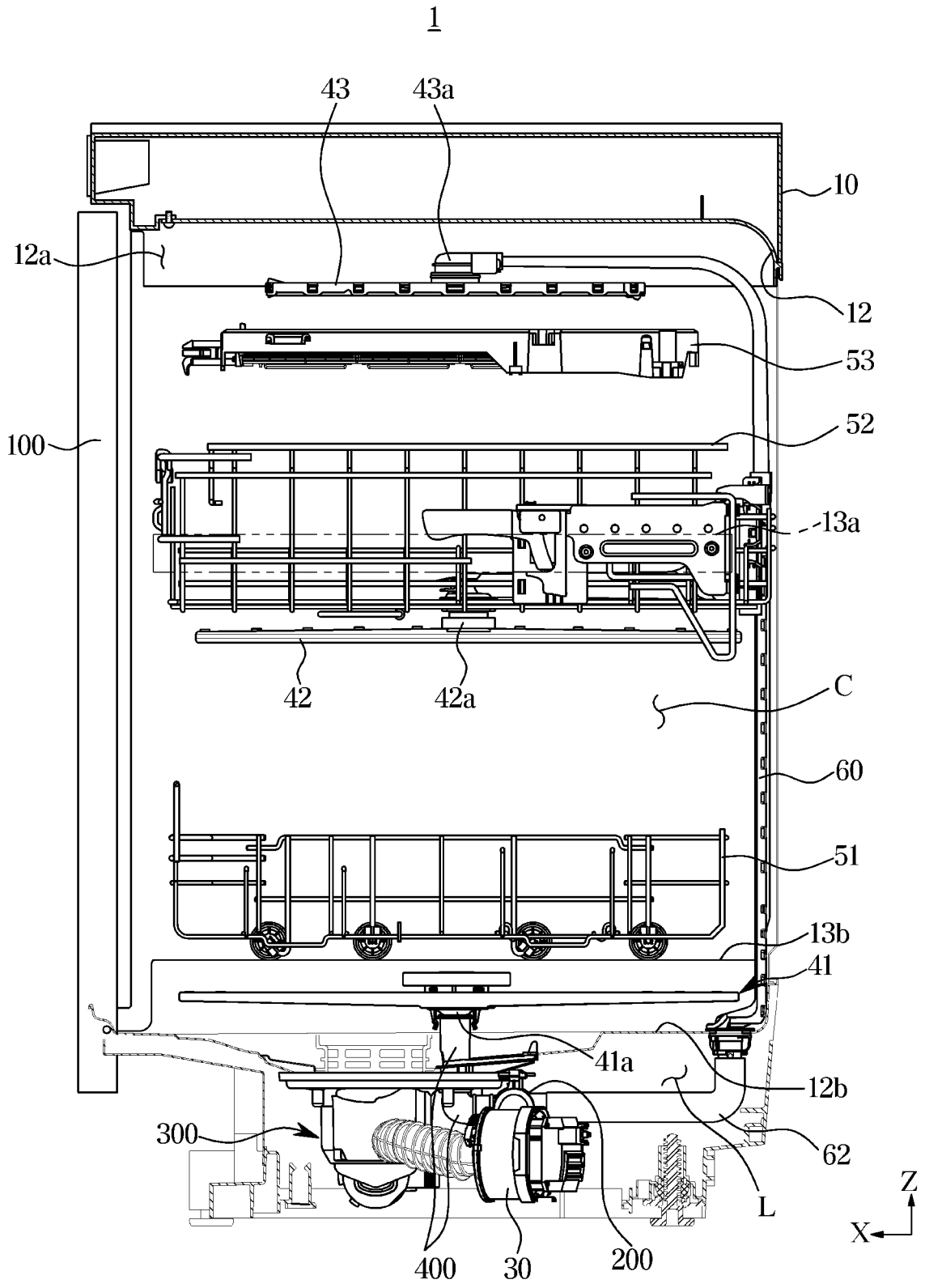
FIG. 1 is a side cross-sectional view of a dishwasher according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are used to describe the embodiments. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the," include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first," "second," etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front", "rear", "upper", and "lower" are defined based on the drawings, and the shapes and positions of the components are not limited by the terms.

Hereinafter, embodiments of the disclosure will be described in detail with reference to the accompanying drawings.

Hereinafter, for convenience of description, an embodiment of a dishwasher will be described, although not limited thereto. The disclosure may be applied to all home appliances including doors, such as a refrigerator, a washing machine, an oven, a microwave, etc.

An aspect of the disclosure provides a dishwasher and a home appliance capable of easily changing a design of a door.

Another aspect of the disclosure provides a dishwasher and a home appliance having an improved coupling structure of a plurality of members forming a door.

According to a concept of the disclosure, a dishwasher and a home appliance may easily change a design of a door by including a door panel detachably mounted on a door body.

According to a concept of the disclosure, a dishwasher and a home appliance may prevent generation of an error at a coupling location or generation of a step in a side of a door after coupling by installing an upper frame in a coupling guide provided in a door body.

FIG. 1 is a side cross-sectional view of a dishwasher according to an embodiment of the disclosure.

Referring to FIG. 1, a dishwasher 1 may include a housing 10 forming an outer appearance. The dishwasher 1 may include a tub 12 provided inside the housing 10. The tub 12 may be substantially in a shape of a box. A front side of the tub 12 may open. That is, the front side of the tub 12 may correspond to an opening 12*a*.

The dishwasher 1 may include a door 100 configured to open or close the opening 12*a* of the tub 12. An upper or lower portion of the door 100 may be hinge-coupled with the housing 10 to open or close the opening 12*a* of the tub 12, although not limited thereto. Also, a side portion of the door 100 may be hinge-coupled with the housing 10 to open or close the opening 12*a* of the tub 12. Also, the door 100 may be mounted on the housing 10 by another opening/closing structure than a hinge.

The dishwasher 1 may further include a storage container provided inside the tub 12 to store dishes. The storage container may include a plurality of baskets 51, 52, and 53.

The plurality of baskets 51, 52, and 53 may be arranged in an up-down direction Z of the dishwasher 1, and the plurality of baskets 51, 52, and 53 may correspond to a lower basket 51, a middle basket 52, and an upper basket 53 from bottom to top. The lower basket 51 may be supported by a lower guide rack 13*b*, and the middle basket 52 may be supported by a middle guide rack 13*a*. The upper basket 53 may be formed in a rack assembly type to store dishes having relatively small volumes. The middle guide rack 13*a* and the lower guide rack 13*b* may be installed on side surfaces of the tub 12 in such a way as to be slidable in a front-rear direction toward the opening 12*a* of the tub 12, although not limited thereto.

However, the upper basket 53 may be omitted according to a size of the tub 12. Accordingly, the storage container may include only the middle basket 52 and the lower basket 51.

The dishwasher 1 may include a sump 300 for storing washing water. The dishwasher 1 may include a washing room C which is a space formed by inside of the tub 12.

The washing room C may be a space where dishes put on the baskets 51, 52, and 53 are washed with washing water and dried. The washing room C may be defined as an inside space of the tub 12, formed by both side surfaces, a rear surface, and a bottom 12*b* of the tub 12, and the sump 300 communicating with the bottom 12*b*. Washing water circulating inside the washing room C may not leak out of the washing room C through other components except for the sump 300.

The dishwasher 1 may include a plurality of arm assemblies 41, 42, and 43 for spraying washing water toward the baskets 51, 52, and 53 to wash dishes stored in the baskets 51, 52, and 53. The arm assemblies 41, 42, and 43 may be arranged in the up-down direction of the washing machine 1, and the arm assemblies 41, 42, and 43 may correspond to a first arm assembly 41, a second arm assembly 42, and a third arm assembly 43 from bottom to top. The first arm assembly 41 may be positioned below the lower basket 51, the second arm assembly 42 may be positioned below the middle basket 52, and the third arm assembly 43 may be positioned above the upper basket 53, although not limited thereto.

For example, the second arm assembly 42 may be positioned above the middle basket 52. Also, in a case in which the upper basket 53 is omitted, the third arm assembly 43 may be provided above the middle basket 52.

The first arm assembly 41 may be rotatable with respect to a rotation shaft 41*a*, the second arm assembly 42 may be rotatable with respect to a rotation shaft 42*a*, and the third arm assembly 43 may be rotatable with respect to a rotation shaft 43*a*.

The first arm assembly 41 may be fixed to one side of the sump 300 to be positioned on the bottom 12*b* of the tub 12, unlike the second arm assembly 42 and the third arm assembly 43.

The dishwasher 1 may include a circulation pump 30 for pumping washing water stored in the sump 300 or washing water entered inside of the dishwasher 1 from outside toward the arm assemblies 41, 42, and 43. Washing water pumped by the circulation pump 30 may be supplied to the first arm assembly 41 through an alternating device 200 connected with the circulation pump 30, or may move upward by a duct 60 to be supplied to the second arm assembly 42 or the third arm assembly 43.

The alternating device 200 may provide washing water to the first arm assembly 41 through a connector 400 connected with the first arm assembly 41, and may provide washing water to the duct 60 through a flow path 62 connected with the duct 60.

The dishwasher 1 may include the connector 400 connecting the alternating device 200 with the first arm assembly 41. One end of the connector 400 may communicate with the alternating device 200, and the other end of the connector 400 may communicate with the first arm assembly 41. Accordingly, washing water pumped by the circulation pump 30, as described above, may enter the alternating device 200, and washing water moved to the connector 400 by the alternating device 200 may be sprayed to the lower basket 51 through the first arm assembly 41, although not limited thereto.

However, the circulation pump 30 may be connected directly with the connector 400, and accordingly, washing water pumped by the circulation pump 30 may enter the first arm assembly 41 directly through the connector 400, without passing through the alternating device 200. In this case, the dishwasher 1 may not include the alternating device 200.

The dishwasher 1 may include a drain hose (not shown) for draining washing water remaining inside the tub 12. The drain hose may be connected with the sump 300 to drain washing water stored inside the sump 300 to outside of the dishwasher 1.

As described above, washing water collected in the sump 300 may be purified by a filter (not shown) inside the sump 300 and then circulate to inside of the washing room C by the circulation pump 30.

In a machine room L formed in a lower portion of the dishwasher 1, components, such as the circulation pump 30, the alternating device 200, the sump 300, etc., may be positioned.

Figure 2:
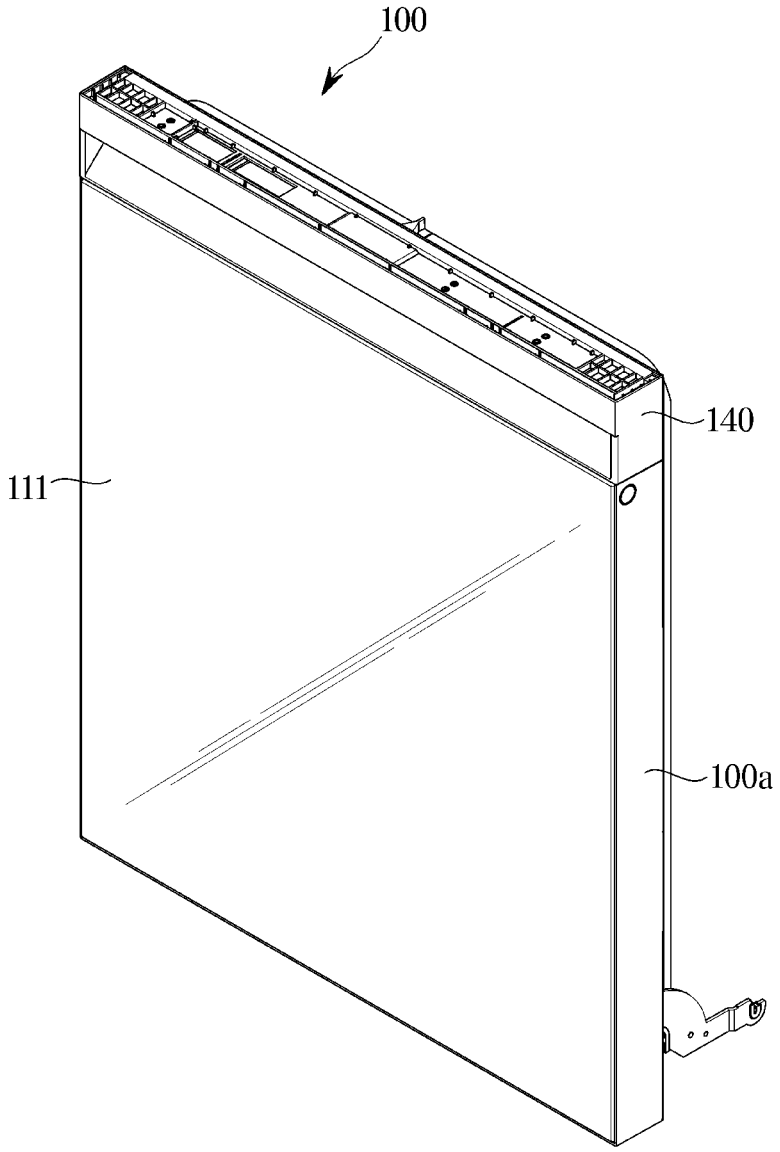
FIG. 2 is a perspective view showing a door of the dishwasher shown in FIG. 1 according to an embodiment of the disclosure.
Figure 3:
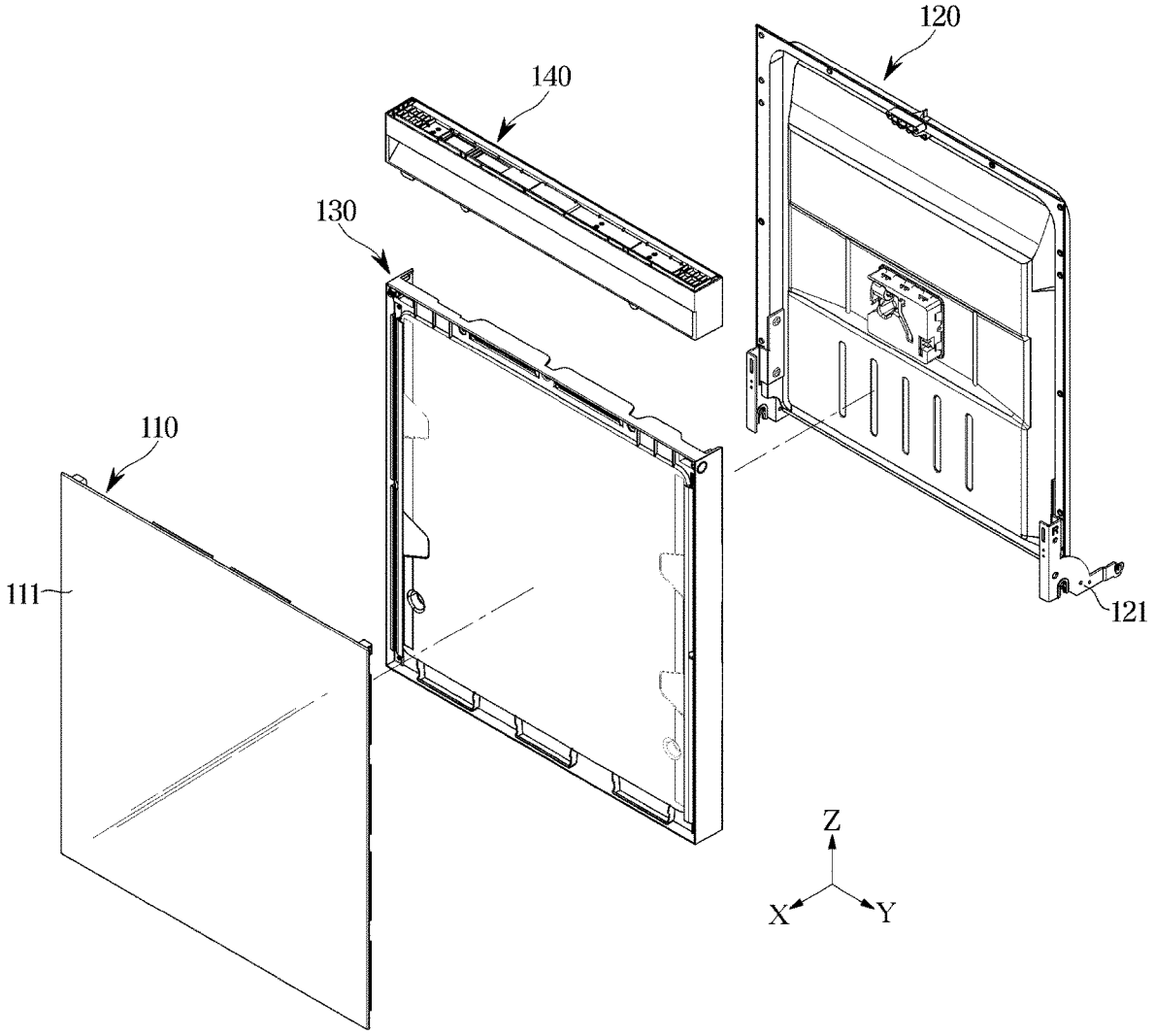
FIG. 3 is an exploded perspective view of the door shown in FIG. 2 according to an embodiment of the disclosure.
Figure 4:
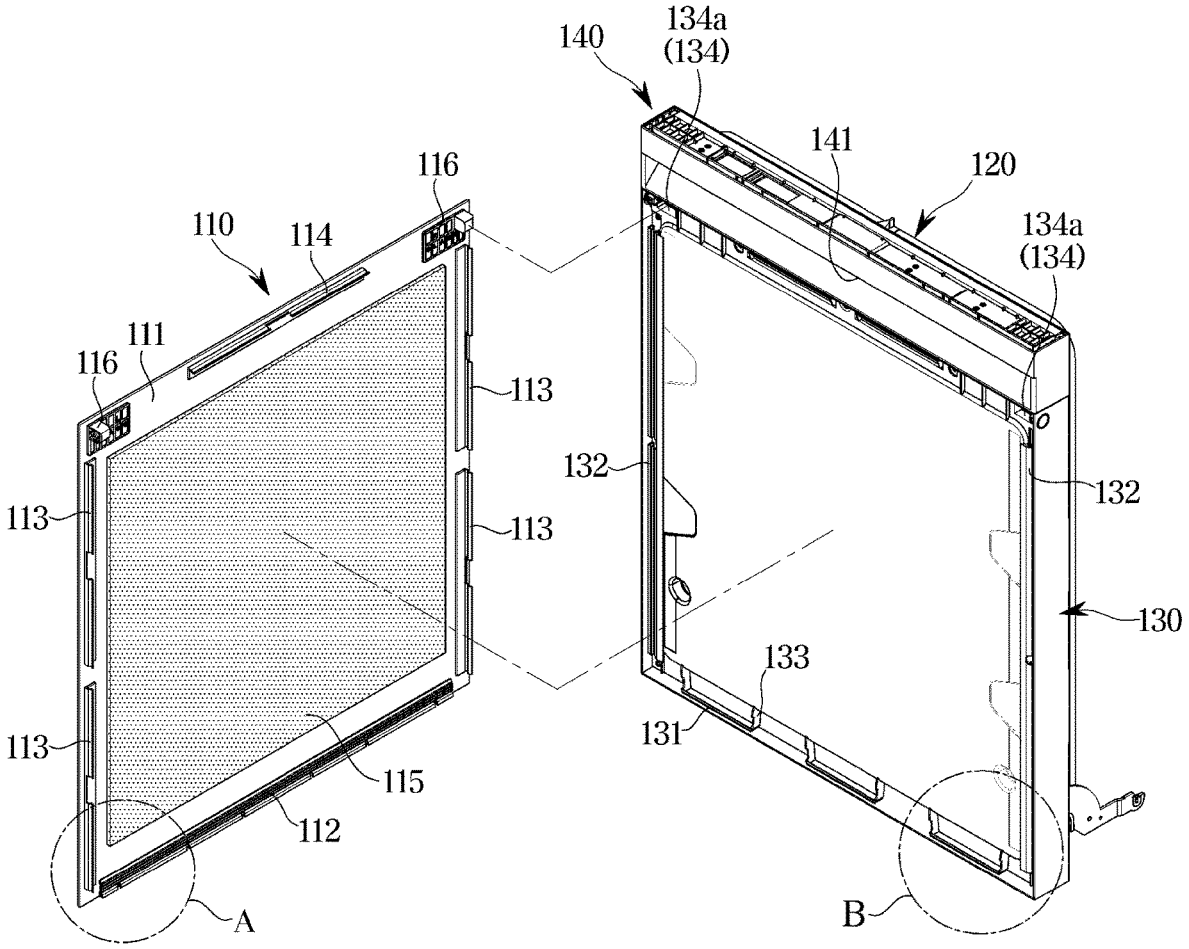
FIG. 4 shows a door panel separated from the door shown in FIG. 2 according to an embodiment of the disclosure.
Figure 5:
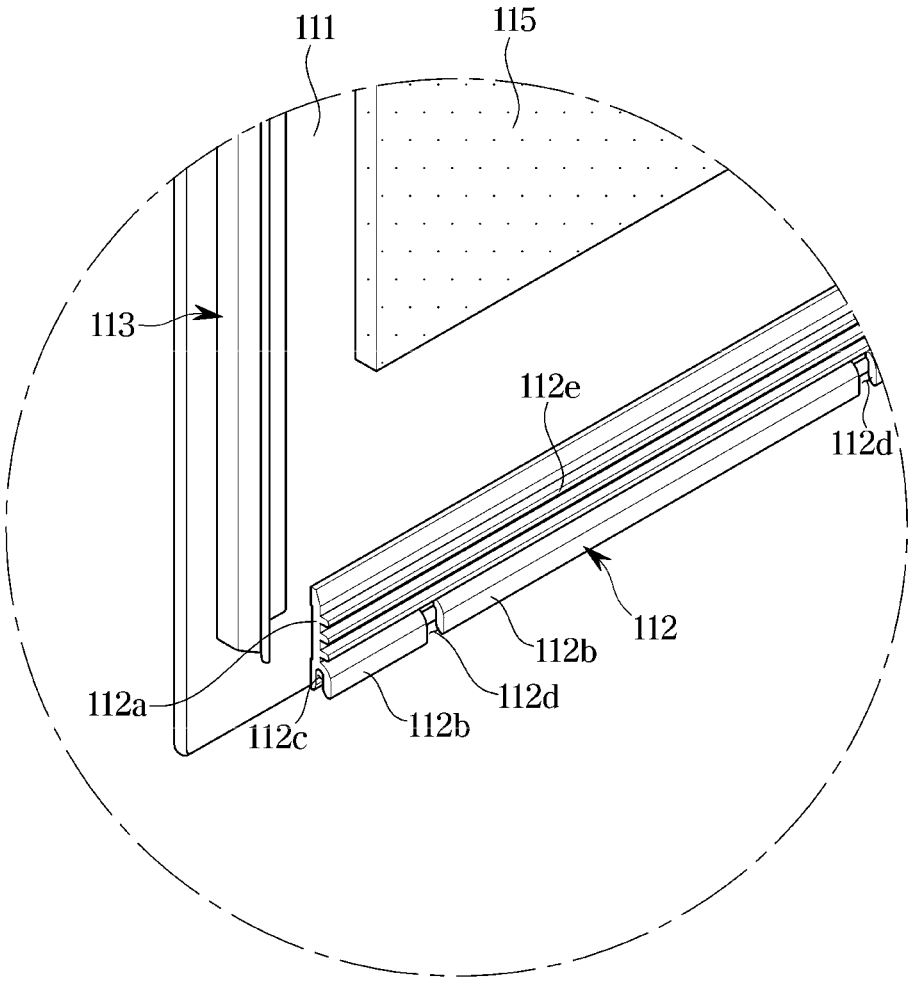
FIG. 5 is an enlarged view of an area A of FIG. 4 according to an embodiment of the disclosure.
Figure 6:
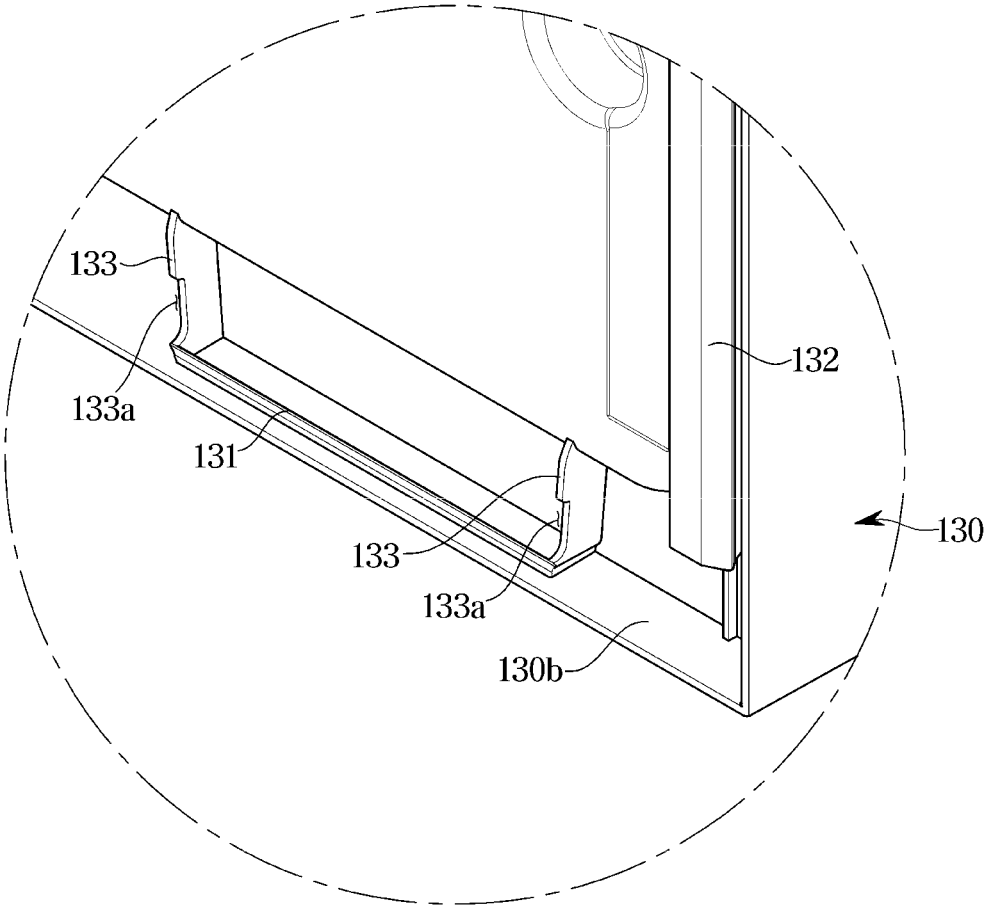
FIG. 6 is an enlarged view of an area B of FIG. 4 according to an embodiment of the disclosure.
Figure 7:
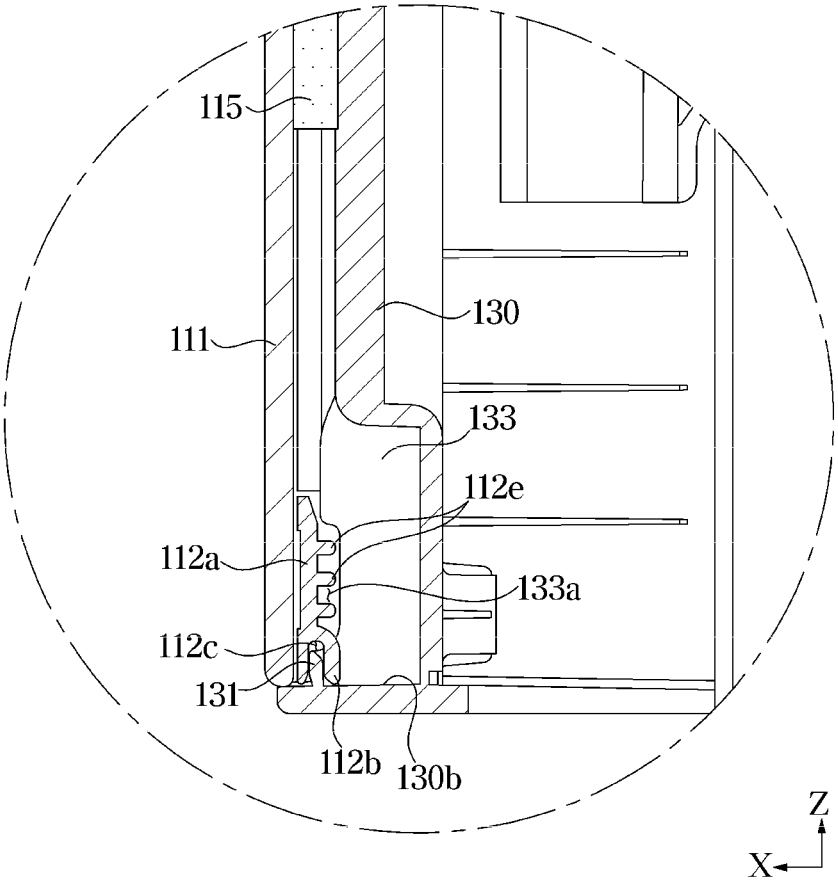
FIG. 7 is a side cross-sectional view of a lower end portion of the door shown in FIG. 2 according to an embodiment of the disclosure.
Figure 8:
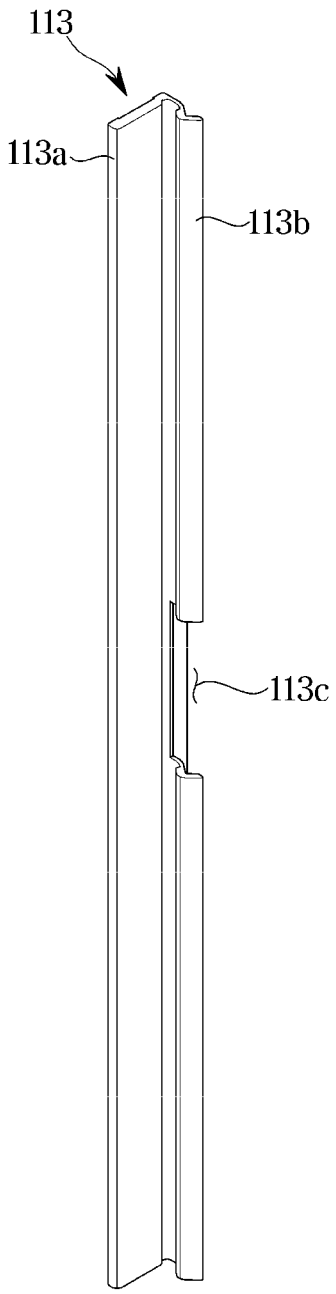
FIG. 8 shows a side trim shown in FIG. 4 according to an embodiment of the disclosure.
Figure 9:
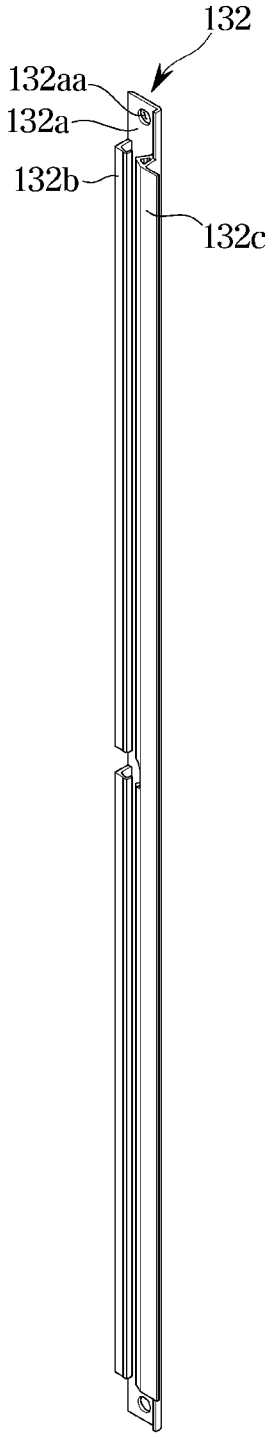
FIG. 9 shows a coupling trim shown in FIG. 4 according to an embodiment of the disclosure.
Figure 10:
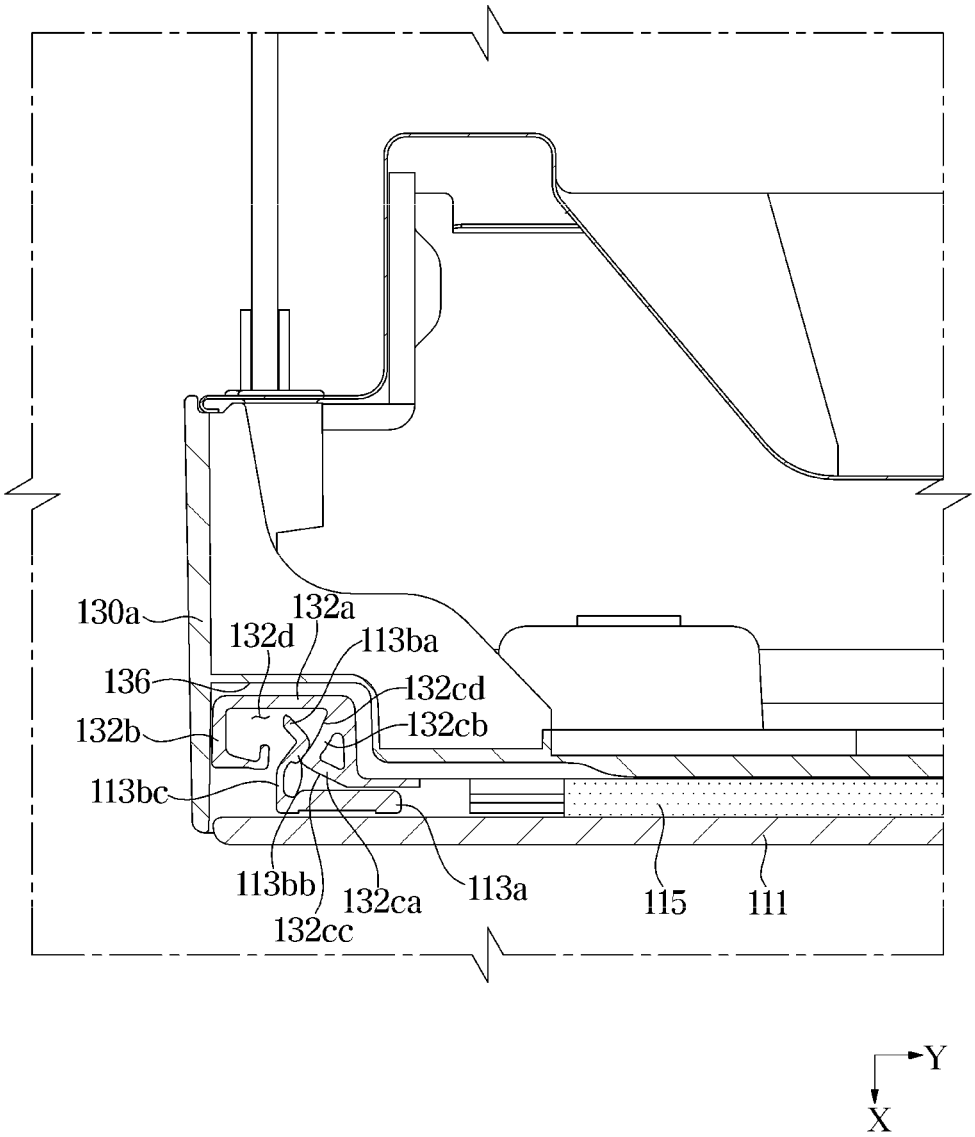
FIG. 10 shows a side trim and a coupling trim upon coupling of a door panel and a door body in the door shown in FIG. 2 according to an embodiment of the disclosure.
Figure 11:
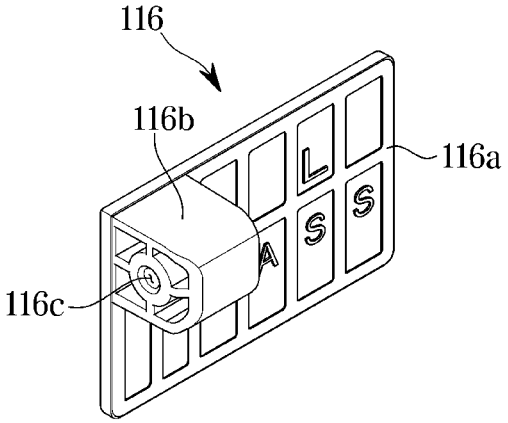
FIG. 11 shows a fixer shown in FIG. 4 according to an embodiment of the disclosure.
Figure 12:
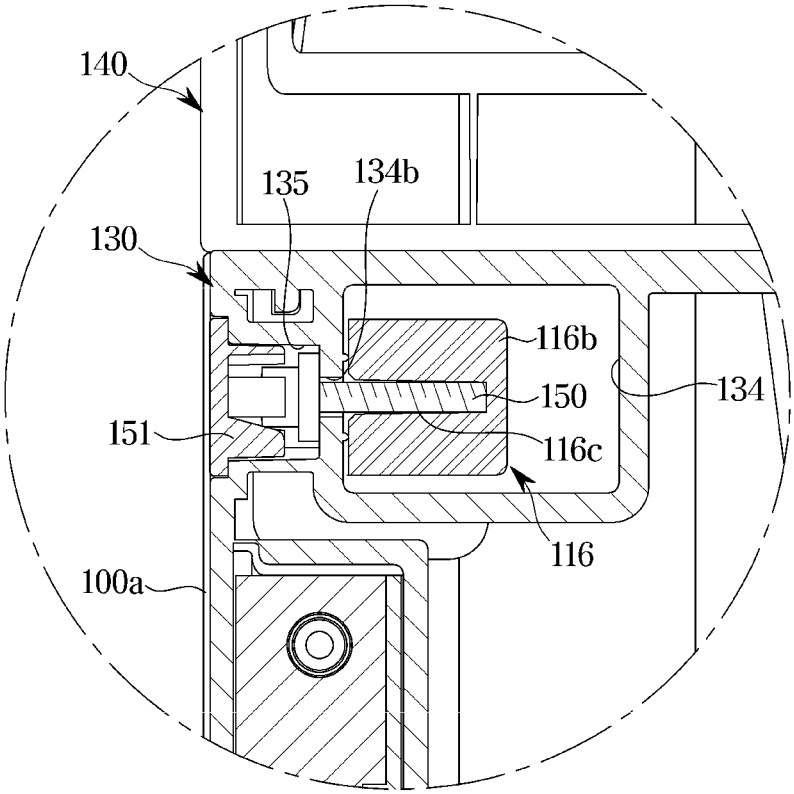
FIG. 12 is a cross-sectional view showing a state in which a fixer is coupled with a coupling member upon coupling of a door panel and a door body in the door shown in FIG. 2 according to an embodiment of the disclosure.

FIG. 2 is a perspective view showing a door of the dishwasher shown in FIG. 1. FIG. 3 is an exploded perspective view of the door shown in FIG. 2. FIG. 4 shows a door panel separated from the door shown in FIG. 2. FIG. 5 is an enlarged view of an area A of FIG. 4. FIG. 6 is an enlarged view of an area B of FIG. 4. FIG. 7 is a side cross-sectional view of a lower end portion of the door shown in FIG. 2. FIG. 8 shows a side trim shown in FIG. 4. FIG. 9 shows a coupling trim shown in FIG. 4. FIG. 10 shows a side trim and a coupling trim upon coupling of a door panel and a door body in the door shown in FIG. 2. FIG. 11 shows a fixer shown in FIG. 4. FIG. 12 is a cross-sectional view showing a state in which a fixer is coupled with a coupling member upon coupling of a door panel a door body in the door shown in FIG. 2.

Hereinafter, the door 100 will be described in detail. Referring to FIGS. 2 to 12, the door 100 may include an inner body 120, a door panel 110, and a door body 130. The door panel 110 and the inner body 120 may be coupled with the door body 130. The door 100 may include a plurality of doors.

The inner body 120 may form a rear surface of the door 100 by being coupled with a rear portion of the door body 130, include a hinge 121 forming a rotation shaft of the door 100 by being coupled with the housing 10, and form one surface of the washing room C.

The door panel 110 may include a front panel 111, a buffer member 115, fixing trims 112, 113, and 114, and a fixer 116. A plurality of door panels 110 may be provided to correspond to the plurality of doors 100.

The front panel 111 may form an outer appearance of the door 100. More specifically, the front panel 111 may form a front surface of the door 100. On the front surface of the front panel 111, various designs for satisfying a user's needs may be provided. On a rear surface of the front panel 111, the fixing trims 112, 113, and 114 and the fixer 116 for coupling with the door body 130 may be positioned, although not limited thereto.

The door panel 110 may be mounted on a side surface of the door body 130 such that the front panel 111 forms a side surface of the door 100. In this case, the same components as those provided on a front surface of the door body 130 may be provided on the side surface of the door body 130, and the same components as those provided on the side surface of the door body 130 may be provided on the front surface and/or rear surface of the door body 130 and/or the door 100.

The front panel 111 may have a thickness of a preset size or more. An end of the front panel 111 may be finished not to be sharp. The front panel 111 may be made of a material, such as glass, metal, wood, silicon, a synthetic resin, etc., although not limited thereto. The front panel 111 may be made of another material capable of being processed to a plate.

The buffer member 115 may be positioned on the rear surface of the front panel 111. The buffer member 115 may be positioned in a space formed between the door panel 110 and the door body 130. The buffer member 115 may prevent an impact applied to the door panel 110 from being transferred to the door body 130. Also, the buffer member 115 may absorb noise that may be generated in the washing room C. The buffer member 115 may include expanded polystyrene, although not limited thereto. However, the buffer member 115 may include another material.

The fixing trims 112, 113, and 114 may include a lower trim 112, an upper trim 114, and a side trim 113. The fixing trims 112, 113, and 114 may be attached to the front panel 111 through an adhesive (not shown). The fixing trims 112, 113, and 114 may be adhered to the front panel 111 by a Poly Urethane Reactive (PUR) adhesive method. However, a method for fixing the fixing trims 112, 113, and 114 is not limited to this. The door panel 110 may be firmly coupled with the door body 130 by the fixing trims 112, 113, and 114 in such a way as to be easily separated from the door body 130.

The lower trim 112 may include a lower trim body 112*a*, a lower trim protrusion 112*b*, a lower trim installing groove 112*c*, a lower trim segmentation portion 112*d*, and a lower trim rib 112*e*. The lower trim 112 may be positioned at a lower edge of the front panel 111.

The lower trim body 112*a* may extend in a left-right direction to be fixed to a lower end of the front panel 111. The lower trim body 112*a* may be substantially in a shape of a rectangular plate. The lower trim body 112*a* may be fixed to the rear surface of the front panel 111 by an adhesive.

The lower trim protrusion 112*b* may protrude backward from the lower trim body 112*a*. The lower trim protrusion 112*b* may extend in the left-right direction Y, like the lower trim body 112*a*. The lower trim installing groove 112*c* may be formed between the lower trim protrusion 112*b* and the lower trim body 112*a*. The lower trim protrusion 112*b* may extend backward from the lower trim body 112*a* by a preset length, and then extend substantially in the up-down direction Z. Accordingly, the lower trim installing groove 112*c* may open downward.

The lower trim installing groove 112*c* may be formed between the lower trim protrusion 112*b* and the lower trim body 112*a*. The lower trim installing groove 112*c* may accommodate a first coupling protrusion 131 protruding upward from a lower surface 130*b* of the door body 130. The lower trim installing groove 112*c* may correspond to a size and/or shape of the first coupling protrusion 112*c*. As a result of insertion of the first coupling protrusion 131 into the lower trim installing groove 112*c*, the lower end of the front panel 111 may be fixed to the door body 130. Also, the lower end of the front panel 111 installed in the door body 130 may contact the lower surface 130*b* of the door body 130 to be supported by the lower surface 130*b* of the door body 130.

The lower trim segmentation portion 112*d* may be formed in the lower trim protrusion 112*b*. The lower trim segmentation portion 112*d* may segment the lower trim protrusion 112*b* into a plurality of portions. A plurality of trim segmentation portions 112*d* may be provided. The portions of the lower trim protrusion 112*b*, segmented by the lower trim segmentation portion 112*d*, may be spaced from each other along a direction in which the lower trim protrusion 112 extends. Because the lower trim segmentation portion 112*d* segments the lower trim protrusion 112*b* into the plurality of portions, the lower trim 112 may be prevented from being damaged by stress applied to the lower trim 112 according to deformation of the front panel 111 by heat.

A support rib 133 formed in a lower end of the door body 130 may be inserted in the lower trim segmentation portion 112*d*. The support rib 133 may extend substantially perpendicularly from the lower surface 130*b* of the door body 130. A thickness of the support rib 133 may be equal to or smaller than a width of the lower trim segmentation portion 112*d*, and a location of the support rib 133 may correspond to a location of the lower trim segmentation portion 112*d*. Accordingly, upon mounting of the door panel 110 on the door body 130, the support rib 133 may be inserted into the lower trim segmentation portion 112*d*, and a movement of the lower trim segmentation portion 112*d* coupled with the support rib 133 may be guided along an extension direction of the support rib 133 in a state in which the support rib 133 is inserted in the lower trim segmentation portion 112*d*.

The lower trim rib 112*e* may protrude backward from the lower trim body 112*a*. The lower trim rib 112*e* may be positioned above the lower trim protrusion 112*b*. A plurality of lower trim ribs 112*e* may be provided.

The lower trim rib 112*e* may extend in the left-right direction Y, like the lower trim body 112*a*. More specifically, the lower trim rib 112*e* may have the same length as the lower trim body 112*a* in the left-right direction Y, although not limited thereto. The lower trim rib 112*e* may have a length in the left-right direction Y, which is different from a length by which the lower trim body 112*a* extends in the left-right direction Y.

The lower trim rib 112*e* may be inserted in and supported by a support groove 133*a* formed in the support rib 133 of the door body 130. Accordingly, the front panel 111 may be firmly supported by the support rib 133, and prevented from being deformed by an external impact.

The upper trim 114 and the side trim 113 may have the same shape. The following description relates to the side trim 113 and a coupling trim 132 corresponding to the side trim 113. However, the following description may also be applied in the significantly same way to the upper trim 114 and a coupling trim (not shown) corresponding to the upper trim 114, although the upper trim 114 has a difference in an extension direction Y.

The side trim 113 may include a side trim body 113*a*, a side trim protrusion 113*b*, and a side trim segmentation portion 113*c*. The side trim 113 may include a plurality of side trims 113 that may be positioned in left and right edges of the front panel 111. The side trim 113 positioned in the left edge of the front panel 111 may be symmetrical to the side trim 113 positioned in the right edge of the front panel 111.

The side trim body 113*a* may be fixed to the left and right ends of the front panel 111, and extend substantially in the up-down direction Z. The side trim body 113*a* may be substantially in a shape of a rectangular plate. The side trim body 113*a* may be fixed to the rear surface of the front panel 111 by an adhesive.

The side trim protrusion 113*b* may protrude backward from the side trim body 113*a*. The side trim protrusion 113*b* may extend in the up-down direction Z, like the side trim body 113*a*. The side trim protrusion 113*b* may be coupled with the coupling trim 132 provided in the door body 130. More specifically, the side trim protrusion 113*b* may be inserted in and supported by a coupling trim installing groove 132*d* formed in the coupling trim 132, and accordingly, the side trim 113 may be fixed to the coupling trim 132.

The side trim protrusion 113*b* may include a material having certain elasticity such that the side trim protrusion 113*b* is deformed by being pressed by the coupling trim 132 upon coupling with the coupling trim 132 and then restored. The side trim protrusion 113*b* may generate an elastic force in a direction of contacting the coupling trim 132 upon mounting of the front panel 111 on the door body 130. A process of coupling between the side trim 113 and the coupling trim 132 will be described in detail below.

The side trim segmentation portion 113*c* may be formed in the side trim protrusion 113*b*. The side trim segmentation portion 113*c* may segment the side trim protrusion 113*b* into a plurality of portions. The portions of the side trim protrusion 113*b*, segmented by the side trim segmentation portion 113*c*, may be spaced from each other along a direction in which the side trim protrusion 113*b* extends. The side trim segmentation portion 113*c* may include a plurality of side trim segmentation portions 113*c*. Because the side trim segmentation portion 113*c* segments the side trim protrusion 112*b* into the plurality of portions, the side trim 113 may be prevented from being damaged by stress applied to the side trim 113 according to deformation of the front panel 111 by heat.

The door body 130 may form an outer surface of the door 100. More specifically, in a case in which the door panel 110 is positioned in front of the door body 130, the door body 130 may form both side surfaces 100*a* and a lower surface of the door 100, and the door panel 110 and an upper frame 140 may be mounted thereon.

In the lower end of the door body 130, the support rib 133 and the first coupling protrusion 131 may be formed. The support rib 133 and the first coupling protrusion 131 may protrude upward from the lower surface 130*b* of the door body 130. The support rib 133 and the first coupling protrusion 131 may be integrated into one body. The door body 130 may include the support rib 133 and the first coupling protrusion 131, although not limited thereto. The support rib 133 and the first coupling protrusion 131 may be provided as separate parts that may be separated from the door body 130.

The door body 130 may include a coupling recess 134 which is formed by depressing a portion of the front surface of the door body 130 and in which the fixer 116 (which will be described below) is inserted. The coupling recess 134 may include an opening 134*a* that opens toward a front direction, and the fixer 116 may be inserted through the opening 134*a*. Because the fixer 116 is positioned in an upper end of the front panel 111, the coupling recess 134 may be formed in an upper end of the door body 130 to correspond to the fixer 116.

In one surface of the coupling recess 134, being adjacent to a side wall 130*a* of the door body 130, a coupling hole 134*b* which communicates with outside of the door 100 and a coupling member 150 penetrates may be formed. More specifically, the door body 130 may include an insertion recess 135 formed by depressing a side surface of the door body 130. One side of the insertion recess 135 may be connected with one side surface 100*a* of the door 100 to communicate with the outside of the door 100, and the other side of the insertion recess 135 may communicate with the coupling hole 134*b*. The coupling hole 134*b* may communicate with the outside of the door 100 through the insertion recess 135. Because one side of the coupling hole 134*b* communicates with the insertion recess 135 and the other side of the coupling hole 134*b* communicates with the coupling recess 134, the coupling recess 134 may communicate with the outside of the door body 130 through the coupling hole 134*a* and the insertion recess 135, although not limited thereto.

However, the insertion recess 135 may be omitted or integrated into the coupling hole 134*a*. In this case, one side of the coupling hole 134*a* may be connected with the side surface 100*a* of the door 100, and the other side of the coupling hole 134*a* may be connected with the coupling recess 134.

The door 100 may include a cap 151 inserted in the insertion recess 135. The cap 151 may be inserted in the insertion recess 135 and coupled with the insertion recess 135. The cap 151 may form a portion of the side surface 100*a* of the door 100 by covering the coupling member 150 inserted in the insertion recess 135 and penetrating the coupling hole 134*a*.

The door 100 may include the coupling trim 132 provided on the front surface of the door body 130. The coupling trim 132 may include a plurality of coupling trims 132. The coupling trim 132 may be positioned at a location corresponding to the side trim 113. The coupling trim 132 may extend in the same direction in which the corresponding side trim 113 extends by the same length as the side trim 113.

The coupling trim 132 may include a coupling trim body 132*a*, a reinforcing flange 132*b* protruding forward from one end of the coupling trim body 132*a*, and a coupling flange 132*c* protruding forward from the other end of the coupling trim body 132*a*.

The coupling trim body 132*a* may be substantially in a shape of a rectangular plate, and may be fixed to the front surface of the door body 130. More specifically, the door body 130 may include a trim fixing groove 136 corresponding to the side trim 113 and extending in the up-down direction Z in front left and right edges of the door body 130, the coupling trim body 132*a* may be inserted in the trim fixing groove 136, and the coupling trim body 132*a* may be inserted in and fixed to the trim fixing groove 136 of the door body 130 by an adhesive, a screw, etc. The coupling trim 132 positioned on the left edge of the door body 130 may be symmetrical to the coupling trim 132 positioned on the right edge of the door body 130.

In a case in which the coupling trim body 132*a* is fixed by a screw, a plurality of coupling holes 132*aa* may be provided in the coupling trim body 132*a*, and screws may penetrate the coupling holes 132*aa* and be coupled with the door body 130.

The reinforcing flange 132*b* may protrude toward the front direction from one end of both ends of the coupling trim body 132*a*, the one end being closer to the outside of the door 100, and may support the side wall 130*a* of the door body 130. An outer surface of the side wall 130*a* of the door body 130 may form a side surface of the door body 130 corresponding to the side surface 100*a* of the door 100. More specifically, one side of the trim fixing groove 136 which the coupling trim 132 is inserted in and fixed to may be formed by an inner surface of the side wall 130*a* of the door body 130, and the reinforcing flange 132*b* protruding from the coupling trim body 132*a* inserted in the trim fixing groove 136 may be in contact with the inner surface of the side wall 130*a* of the door body 130 to support the side wall 130*a* of the door body 130. Therefore, the reinforcing flange 132 may prevent the side surface 100*a* of the door 100 from being deformed by an impact applied to the side surface 100*a* of the door 100.

The coupling flange 132*c* may include a guide portion 132*ca* inducing elastic deformation of the side trim protrusion 113*b*, and a supporter 132*cb* supporting the side trim protrusion 113*b* coupled with the coupling trim 132.

The guide portion 132*ca* may be exposed to the outside in the front direction of the door body 130, and include a guide inclined surface 132*cc* inclined in a direction that is away from the front panel 111 as the guide inclined surface 132*cc* is more distant from a center of the door body 130. The guide inclined surface 132*cc* may be in contact with the side trim protrusion 113*b*.

The supporter 132*bc* may include a support inclined surface 132*cd* bent and extending from one end of the guide portion 132*a*, which is most distant from the front panel 111, and inclined in the direction that is away from the front panel 111 as the support inclined surface 132*cd* is closer to the center of the door body 130. The support inclined surface 132*cd* may be in contact with the side trim protrusion 113*b*. The guide portion 132*ca* and the supporter 132*cb* may be integrated into one body.

The coupling trim 132 may include the coupling trim installing groove 132*d* formed by the coupling trim body 132*a*, the reinforcing flange 132*b*, and the coupling flange 132*c*, and the side trim protrusion 113*b* may be fixed to the coupling trim 132 by being inserted into the coupling trim installing groove 132*d* formed by the coupling trim 132.

Meanwhile, because the side trim 113 is fixed to the rear surface of the front panel 111, the side trim protrusion 113*b* may be inserted in and coupled with the coupling trim installing groove 132*d* corresponding to the side trim protrusion 113*b* upon mounting of the door panel 110 on the door body 130. The side trim protrusion 113*b* may include a pressed portion 113*ba* pressed toward the side wall 130*a* of the door body 130 by the guide portion 132*ca*, a contact portion 113*bb* connected with the pressed portion 113*ba*, being in contact with the support portion 132*cb*, and supported by the support portion 132*cb*, and an elastic deformation portion 113*bc* connecting the contact portion 113*bb* with the side trim body 113*a* and elastically deformed as the pressed portion 113*ba* is pressed. The contact portion 113*bb* may extend at the substantially same inclination as that of the support inclined surface 132*cd* from one end of the elastic deformation portion 113*bc* vertically protruding from the side trim body 113*a*, and the pressed portion 113*ba* may be bent and extend from one end of the contact portion 113*bb*, at the substantially same inclination as that of the guide inclined surface 132*cd*, although not limited thereto.

The guide portion 132*ca* may be omitted from the coupling trim 132. In this case, the pressed portion 113*ba* of the side trim protrusion 113*b* may be pressed by one end of the support portion 132*cb*. Also, the coupling trim 132 and the door body 130 may be integrated into one body. For example, the coupling trim 132 corresponding to the upper trim 114 of the door 100, as shown in the drawings, may be integrated into the door body 130, and the guide portion 132*ca* may be omitted.

The door 100 may include the fixer 116 positioned on the rear surface of the front panel 111 and fixing the front panel 111 to the door body 130. The fixer 116 may include a plurality of fixers 116. The fixer 116 may be positioned in the upper end of the front panel 111, and fixed to the rear surface of the front panel 111 by an adhesive.

The fixer 116 may include a plate portion 116*a* fixed to the rear surface of the front panel 111, a body portion 116*b* protruding from the plate portion 116 toward a rear direction of the front panel 111, and a coupling portion 116*c* formed in a side surface of the body portion 116*b*.

The body portion 116*a* of the fixer 116 may be inserted in the corresponding coupling recess 134. After the body portion 116*a* of the fixer 116 is inserted in the coupling recess 134, the coupling portion 116*c* may be positioned to correspond to the coupling hole 134*b* formed in one surface of the coupling recess 134. That is, the coupling portion 116*c* may face the coupling hole 134*b*.

The coupling member 150 may penetrate a side of the door body 130, the insertion recess 135, and the coupling hole 134*b* in a direction that is perpendicular to the side surface 100*a* of the door 100, and the coupling member 150 may be coupled with a side surface of the fixer 116 that is inserted into the coupling recess 134 in a direction that is perpendicular to the direction in which the coupling member 150 penetrates the coupling hole 134*b*. More specifically, the coupling member 150 may be detachably coupled with the coupling portion 116*c* formed in the body portion 116*b* of the fixer 116 that is inserted into the coupling recess The coupling member 150 may include a positioning member, such as a screw, a pin, etc. As such, the door panel 110 may be firmly mounted on the door body 130 by the coupling member 150 and the fixer 116 fixed to the front panel 111.

Also, in the door 100 that opens by rotating such that the front surface is toward a down direction, the door panel 110 may be unintentionally separated from the door body 130 by gravity unless a sufficient fixing force is supplied to the door panel 110 forming the front surface of the door 100. Accordingly, the fixer 116 and the coupling member 150 may provide a sufficient fixing force to the door panel 110 to prevent the door panel 110 from being unintentionally separated from the door body 130.

Figure 13:
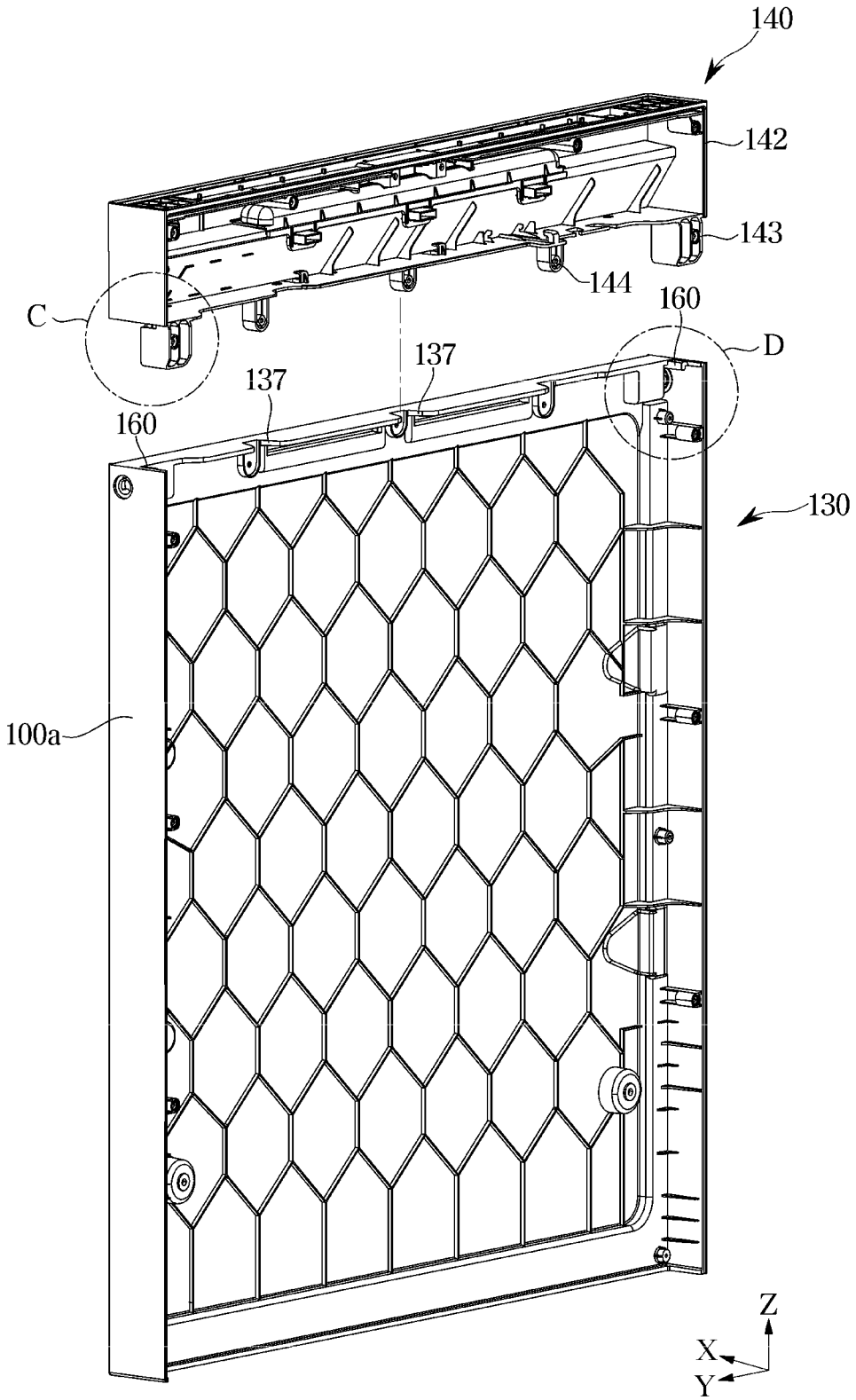
FIG. 13 is an exploded view of a door body and an upper frame in the door shown in FIG. 2 according to an embodiment of the disclosure.
Figure 14:
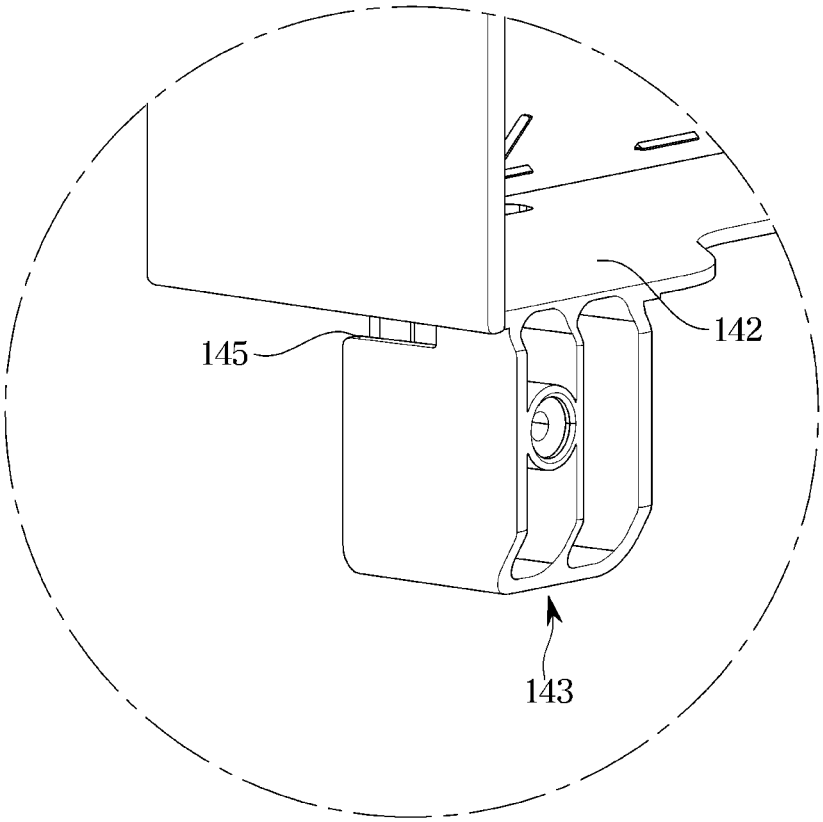
FIGS. 14 and 15 are enlarged views of an area C of FIG. 13 according to an embodiment of the disclosure.
Figure 15:
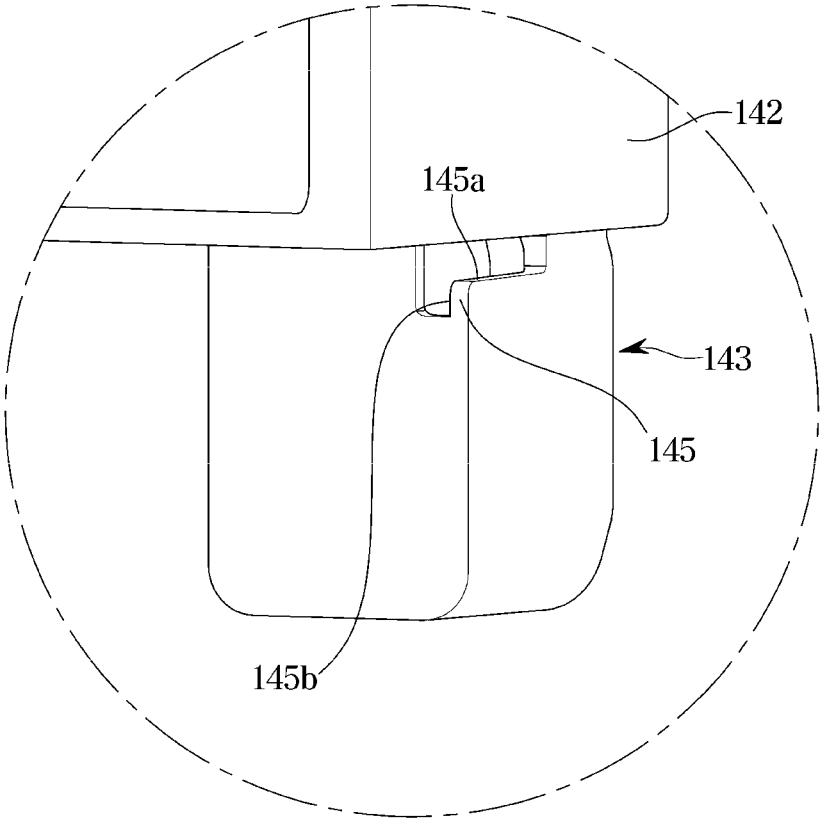
Figure 16:
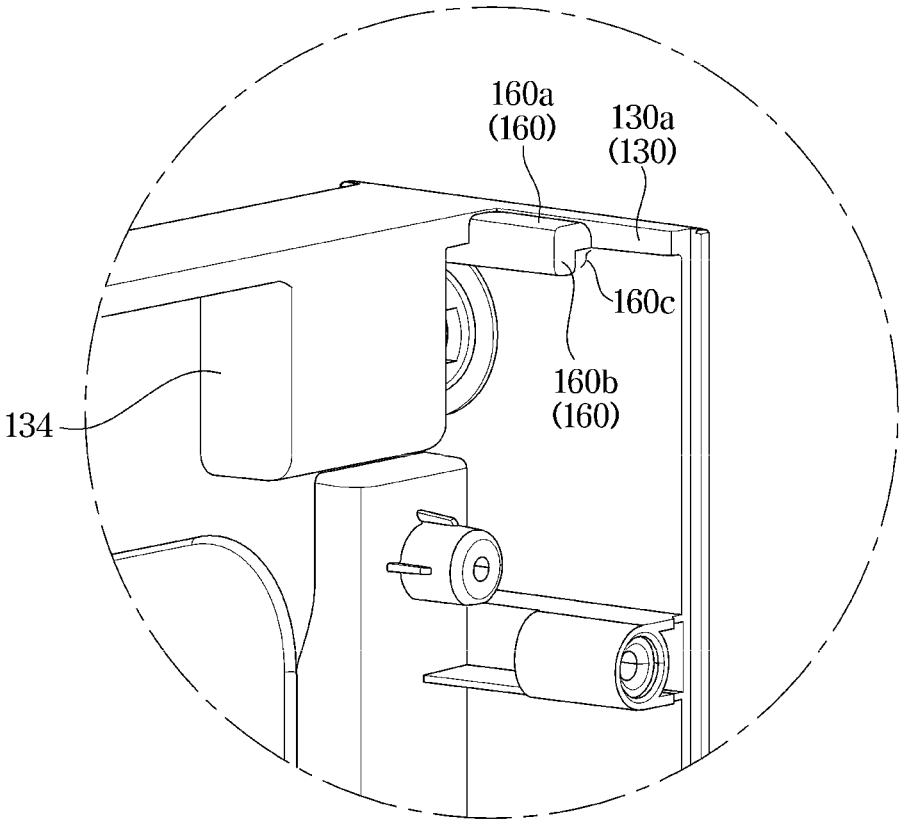
FIG. 16 is an enlarged view of an area D of FIG. 13 according to an embodiment of the disclosure.
Figure 17:
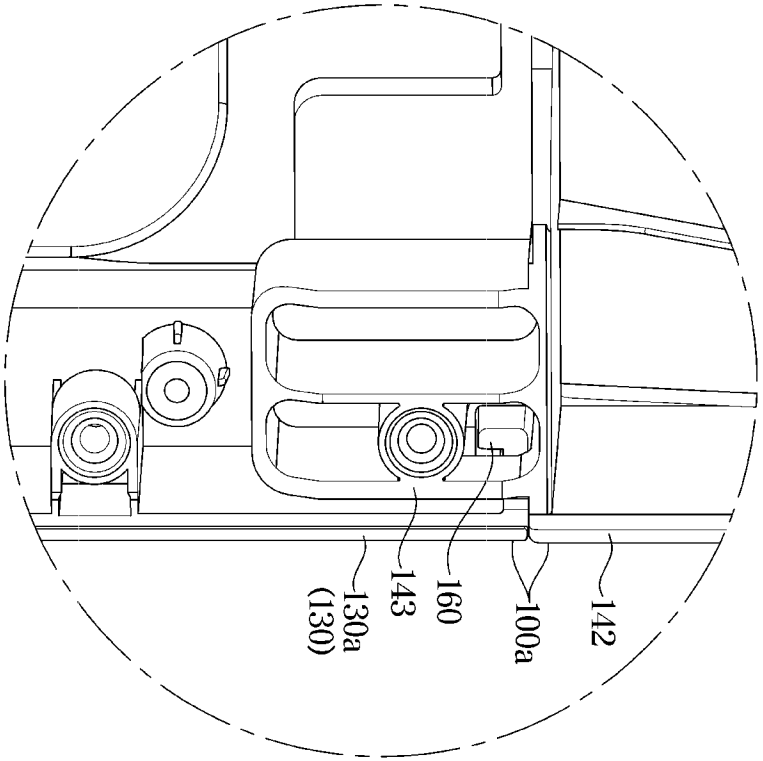
FIG. 17 is an enlarged view of the area D of FIG. 13 upon coupling of the door body and the upper frame of FIG. 13 according to an embodiment of the disclosure.

FIG. 13 is an exploded view of a door body and an upper frame in the door shown in FIG. 2. FIGS. 14 and 15 are enlarged views of an area C of FIG. 13. FIG. 16 is an enlarged view of an area D of FIG. 13. FIG. 17 is an enlarged view of the area D of FIG. 13 upon coupling of the door body and the upper frame of FIG. 13.

Referring to FIGS. 13 to 15, the door 100 may include the upper frame 140 mounted on the door body 130 and forming an upper surface of the door 100 and a portion of the side surface 100*a* of the door 100.

The upper frame 140 may include a control panel (not shown) for controlling operations of the dishwasher 1. More specifically, the control panel may be positioned on the upper fame 140 to be provided on an upper surface of the door 100. Also, the upper frame 140 may include a handle 141 of the door 100.

The upper frame 140 may include a frame portion 142 forming an outer appearance and the handle 141, a coupling portion 144 protruding downward from the frame portion 142, wherein a coupling member (not shown) fixed to the door body 130 penetrates the coupling portion 144, and a fixing portion 143 protruding downward from the frame portion 142 and supported by the coupling guide 160.

Meanwhile, the door 100 may include a coupling guide 160 supporting the fixing portion 143 of the upper frame 140 and guiding a movement of the fixing portion 143. The coupling guide 160 may extend in the front-rear direction X. The coupling guide 160 may be positioned at upper ends of both side portions of the door body 130 to correspond to the fixing portion 143 of the upper frame 140. The coupling guide 160 may form a guide installing groove 160*c* into which a portion of the fixing portion 143 is inserted and which extends in the front-back direction X.

The coupling guide 160 may be formed by protruding from the inner surface of the side wall 130*a* of the door body 130. The coupling guide 160 and the door body 130 may be integrated into one body, although not limited thereto. However, the coupling guide 160 may be provided as a separate component and then coupled with the door body 130. Also, the coupling guide 160 may be provided at another location that may correspond to the fixing portion 143 of the upper frame 140.

The upper frame 140 may include a second coupling protrusion 145 formed on one surface of the fixing portion 143, inserted in the guide installing groove 160*c* formed by the coupling guide 160, and guiding a movement of the upper frame 140. More specifically, the coupling guide 160 may include a first extension portion 160*a* protruding from the side wall 130*a* of the door body 130 and a second extension portion 160*b* extending downward from an end of the first extension portion 160*a*, an upper surface 145*a* of the second coupling protrusion 145 may be supported by the first extension portion 160*a*, and a side surface 145*b* of the second coupling protrusion 145 forming a portion of the inner surface of the fixing portion 143 may be supported by the second extension portion 160*b*, although not limited thereto.

However, for example, the coupling guide 160 may include a third extension portion spaced from the second extension portion 160*b* and extending downward from the first extension portion 160*a*, the guide installing groove 160*c* may be provided between the second extension portion 160*b* and the third extension portion, and a side surface of the second coupling protrusion 145 forming a portion of an outer surface of the fixing portion 143 may be supported by the third extension portion.

The coupling portion 144 may protrude downward from a lower surface of the frame portion 142, be inserted in a coupling portion inserting groove 137 formed in the upper surface of the door body 130, and coupled with the rear surface of the door body 130 by a coupling member (not shown), although not limited thereto.

However, the upper frame 140 may be installed below the door body 130 to form a lower surface of the door 100. In this case, the frame portion 142, the coupling portion 144, the fixing portion 143, the second coupling protrusion 145, the coupling guide 160, etc. may be the substantially same as the corresponding components used in the case in which the upper frame 140 is mounted on the top of the door body 130, except that the frame portion 142, the coupling portion 144, the fixing portion 143, the second coupling protrusion 145, the coupling guide 160, etc. are mirror-symmetrical to the corresponding components with respect to a horizontal surface being parallel to the upper and lower surfaces of the door 100.

Figure 18:
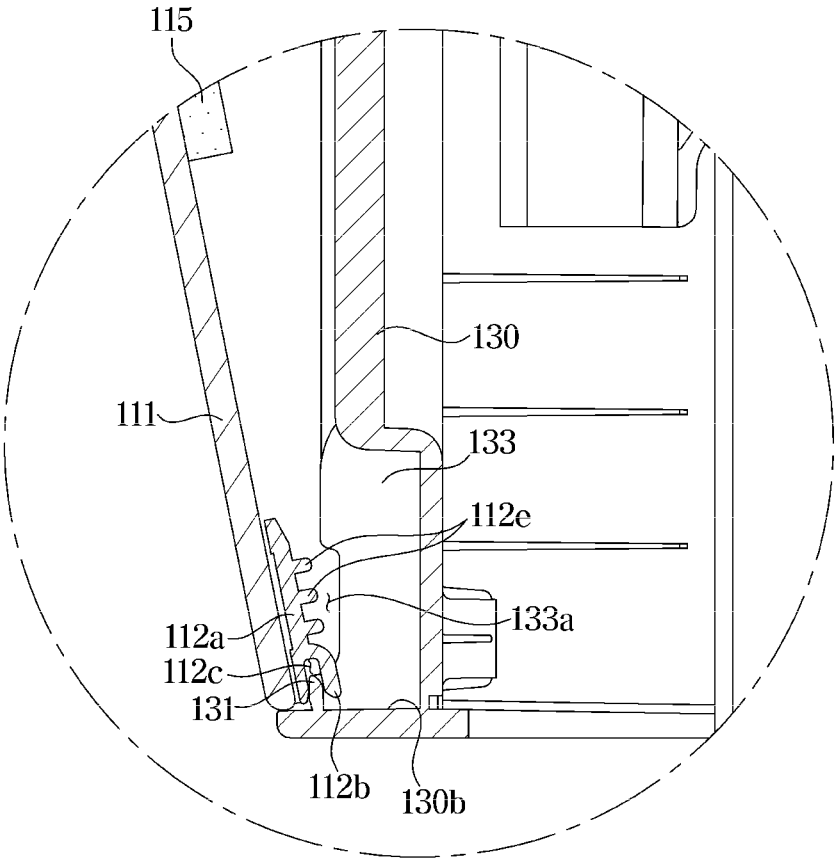
FIG. 18 shows a state in which a lower trim shown in FIG. 7 is coupled with a door body according to an embodiment of the disclosure.
Figure 19:
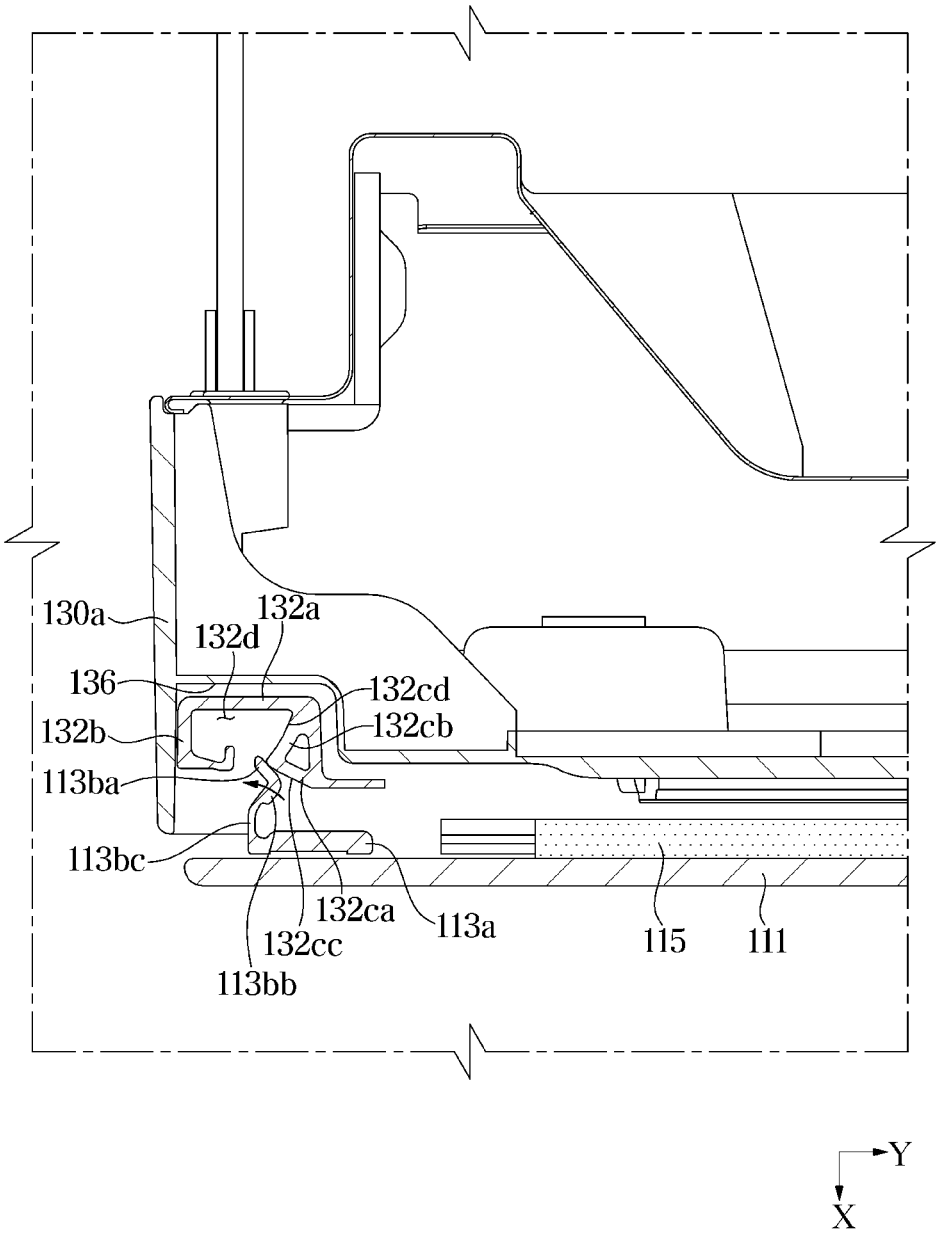
FIG. 19 shows a state in which the side trim shown in FIG. 10 is coupled with the coupling trim.

FIG. 18 shows a state in which a lower trim shown in FIG. 7 is coupled with a door body. FIG. 19 shows a state in which the side trim shown in FIG. 10 is coupled with the coupling trim.

A process of assembling the door panel 110 and the upper frame 140 with the door body 130 will be described in detail with reference to FIGS. 4, 7, 10, 13, and 16 to 19.

First, a process of assembling the door panel 110 will be described. The door panel 110 being in a state separated from the door body 130 may be prepared in a state in which the lower trim 112, the side trim 113, the upper trim 114, the buffer member 115, and the fixer 116 are attached to the rear surface of the front panel 111.

The door panel 110 may be positioned such that the lower trim 112 is toward the first coupling protrusion 131 of the door body 130. In a state in which the door panel 110 is positioned such that an end of the first coupling protrusion 131 is located at an entrance of the lower trim installing groove 112*c*, the door panel 110 may rotate such that the first coupling protrusion 131 is inserted into the lower trim installing groove 112*c*. Referring to FIG. 18, the door panel 110 may rotate in a clockwise direction and accordingly, a lower end of the door panel 110 may be primarily installed in the door body 130, as shown in FIG. 7. At this time, the lower trim rib 112*e* may be inserted in the support groove 133*a* formed in the support rib 133 of the door body 130.

By rotating the door panel 110 to be coupled with the door body 130, the side trim 113 may be coupled with the coupling trim 132. The side trim 113 may be coupled with the coupling trim 132 sequentially from bottom to top.

More specifically, as the pressed portion 113*ba* corresponding to one end of the side trim 113 contacts the guide portion 132*ca* of the coupling trim 132, the pressed portion 113*ba* of the side trim protrusion 113*b* may be pressed while being in contact with a guide inclined surface 113*cc*, and the side trim protrusion 113*b* may be elastically deformed to be inclined more toward a side direction of the door 110 than before being pressed.

In this state, as the door panel 110 becomes closer to the door body 130, the pressed portion 113*ba* may move in a rear direction of the door 100 along the guide inclined surface 113*cc*. That is, the pressed portion 113*ba* may be guided to move toward the entrance of the coupling trim installing groove 132*d* by the guide inclined surface 113*cc*. According to arriving of an end of the pressed portion 113*ba* toward the contact portion 113*bb* at an end of the guide inclined surface 132*cc*, pressure applied by the guide inclined surface 132*cc* may disappear, and accordingly, the pressed portion 113*ba* may be elastically restored to a location before being pressed. Because the end of the guide inclined surface 132*cc* forms the entrance of the coupling trim installing groove 132*d*, the pressed portion 113*ba* arrived at the end of the guide inclined surface 132*cc* may be inserted in the coupling trim installing groove 132*d*.

Accordingly, upon restoring of the pressed portion 113*ba* inserted in the coupling trim installing groove 132*d* to an original location before being pressed, the contact portion 132*bb* may contact the support portion 132*cb* positioned behind the guide portion 132*ca*, and the contact portion 113*bb* may be supported by the support inclined surface 132*cd* to prevent the side trim 113 from being easily separated in the front direction.

Upon completion of coupling of the side trim 113, the upper trim 114 may be coupled with the corresponding coupling trim 132. This may be similar to coupling of the side trim 113, and therefore, a detailed description thereof will be omitted.

Upon completion of coupling of the side trim 113, the fixer 116 may be inserted into the corresponding coupling recess 134. The coupling member 150 inserted in the door body 130 through the side of the door body 130 may be coupled with the fixer 116 inserted in the coupling recess 134. According to coupling of the coupling member 150 with the fixer 116, the front panel 111 may be firmly fixed to the door body 130 through the fixer 116. The cap 151 may be coupled with the insertion recess 135.

As such, upon completion of coupling of the lower trim 112, the side trim 113, the upper trim 114, and the fixer 116, coupling between the door panel 110 and the door body 130 may be completed.

By performing the above-described process in reverse, the door panel 110 may be separated from the door body 130.

A process of assembling the upper frame 140 will be described below. The upper frame 140 being in a state separated from the door body 130 may be positioned such that the fixing portion 143 is positioned behind the coupling guide 160 and the coupling portion 144 is positioned behind the coupling portion inserting groove 137.

In a state in which the upper frame 140 is positioned such that the end of the second coupling protrusion 145 is located at the entrance of the guide installing groove 160*c* formed by the coupling guide 160, the upper frame 140 may slide such that the second coupling protrusion 145 is inserted in the guide installing groove 160*c*. More specifically, referring to FIGS. 13 and 17, the upper frame 140 may be installed by being pushed in the front direction from behind the door 100, and upon pushing of the upper frame 140, the second coupling protrusion 145 of the fixing portion 143 may be inserted in the guide installing groove 160*c* and move. The coupling guide 160 may guide a movement of the second coupling protrusion 145, and support the second coupling protrusion 145 inserted in the guide installing groove 160*c*.

Upon inserting of the second coupling protrusion 145 in the coupling guide 160, the coupling portion 144 may also be inserted in the coupling portion inserting groove 137. According to completion of insertion of the second coupling protrusion 145 and the coupling portion 144, the lower surface of the frame portion 142 of the upper frame 140 may contact the upper surface of the door body 130 in such a way as to face the upper surface of the door body 130. After the coupling portion 144 is completely inserted, the coupling member (not shown) may be coupled with the coupling portion 144 and the door body 130, thereby fixing the upper frame 140 to the door body 130. Through the process, the upper frame 140 may be installed in the door body 130, and by performing the above-described process in reverse, the upper frame 140 may be separated from the door body 130.

As such, because a location and movement of the upper frame 140 are guided by the coupling guide 160, generation of an error at a coupling location upon coupling of the upper frame 140 may be prevented, and generation of a step in the side surface 100*a* of the door 100, formed by the door body 130 and the upper frame 140, may be prevented.

Also, because the coupling member 150 that is coupled with the fixer 116 is coupled with the fixer 116 by penetrating the side of the door body 130, not the upper surface of the door body 130, the coupling member 150 may be not interfere with the upper frame 140 positioned above the door body 130. Accordingly, installation of the door panel 110 and installation of the upper frame 140 may be not influenced by an installation order, and a task of coupling the coupling member 150 with the fixer 116 may be performed in a sufficient task space without any interference with the upper frame 140. A user may mount the door panel 110 on the door body 130 or separate the door panel 110 from the door body 130 freely without performing a task of separating the upper frame 140.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. A home appliance including a door, the door comprising:

a door body;

an upper frame mountable on an upper portion of the door body;

a front panel coupleable to and decoupleable from a front of the door body; and a fixer formed at a rear surface of the front panel and coupleable to a coupling member to fix the front panel to the door body, the fixer including a plate portion fixed to the rear surface of the front panel and a body portion protruding from the plate portion toward a rear direction of the front panel, wherein the coupling member is coupled to the body portion of the fixer by penetrating a side of the door body to thereby couple the front panel to the front of the door body with the coupling member and the fixer to prevent interference with the upper frame while the upper frame is mounted on the upper portion of the door body.

2. The home appliance of claim 1, wherein the door body comprises:

a coupling recess forming an opening toward a front direction, the fixer being insertable into the coupling recess through the opening, wherein a coupling hole exposed to an outside of the door body and through which the coupling member penetrates is formed on a surface of the coupling recess.

3. The home appliance of claim 2, wherein the coupling member which penetrates the coupling hole is coupled to a side surface of the body portion of the fixer while the fixer is inserted into the coupling recess, wherein the coupling member is accommodated inside the body portion.

4. The home appliance of claim 3, wherein while the fixer is inserted in the coupling recess, a direction in which the fixer is inserted in the coupling recess is perpendicular to a direction in which the coupling member penetrates the coupling hole.

5. The home appliance of claim 2, wherein the door body comprises:

an insertion recess formed by depressing a surface of the side of the door body, and wherein the coupling member is inserted into the insertion recess and through to the coupling hole and the coupling recess.

6. The home appliance of claim 5, further comprising a cap coupleable to the insertion recess and configured to cover the coupling member inserted in the insertion recess.

7. The home appliance of claim 1, further comprising a coupling guide formed to protrude from an inner side surface of the door body and configured to support the upper frame.

8. The home appliance of claim 7, wherein the upper frame comprises:

a frame portion, and a fixing portion formed to protrude along a downward direction from the frame portion and supported by the coupling guide, wherein a coupling protrusion is formed on one surface of the fixing portion, and the coupling protrusion is insertable into and supportable by an installing groove formed by the coupling guide.

9. The home appliance of claim 8, wherein upon mounting of the upper frame on the door body, the coupling protrusion slides along a front-rear direction in the installing groove, and the coupling guide guides a movement of the coupling protrusion.

10. The home appliance of claim 1, wherein a handle is formed on the upper frame.

11. A home appliance including a door, the door comprising:

a door body:

an upper frame mountable on an upper portion of the door body:

a front panel coupleable to and decoupleable from a front of the door body; and a fixer formed at a rear surface of the front panel and coupleable to a coupling member to fix the front panel to the door body, the coupling member being coupled to the fixer by penetrating a side of the door body to prevent interference with the upper frame while the upper frame is mounted on the upper portion of the door body a trim arranged on the rear surface of the front panel, forming an installing groove, and coupleable to the door body by being rotatable with respect to the door body such that a portion of the door body is inserted in the installing groove.

12. The home appliance of claim 11, wherein the fixer is at an upper portion of the front panel, and the trim is at a lower portion of the front panel.

13. The home appliance of claim 12, wherein the installing groove is open along a downward direction, the door body comprises a coupling protrusion formed to protrude along an upward direction from a lower surface of the door body, the coupling protrusion is insertable into the installing groove, and the front panel is supported by the lower surface of the door body.

14. The home appliance of claim 12, wherein the trim and the installing groove are a first trim and a first installing groove, respectively, the home appliance further comprising:

a second trim at an edge of the rear surface of the front panel; and a third trim, at an edge of a front surface of the door body to correspond to the second trim, and forming a second installing groove in which the second trim is insertable.

15. The home appliance of claim 14, wherein the second trim is elastically deformable, and the third trim comprises:

a guide portion configured to induce one end of the second trim to be deformed such that the one end of the second trim is toward the second installing groove upon mounting of the front panel on the door body, and a support portion configured to support the second trim by contacting the second trim upon inserting of the one end of the second trim in the second installing groove.

* * * * *